US009458065B2

(12) United States Patent
Kobayashi et al.

(10) Patent No.: US 9,458,065 B2
(45) **Date of Patent: *Oct. 4, 2016**

(54) GAS GENERATING COMPOSITION

(75) Inventors: Syouji Kobayashi, Tatsuno (JP); Jianzhou Wu, Danyang (CN)

(73) Assignee: DAICEL CORPORATION, Osaka (JP)

( * ) Notice: Subject to any disclaimer, the term of this patent is extended or adjusted under 35 U.S.C. 154(b) by 8 days.

This patent is subject to a terminal disclaimer.

(21) Appl. No.: 13/985,350

(22) PCT Filed: Mar. 22, 2012

(86) PCT No.: PCT/JP2012/057258

§ 371 (c)(1),
(2), (4) Date: Aug. 14, 2013

(87) PCT Pub. No.: WO2012/133072

PCT Pub. Date: Oct. 4, 2012

(65) Prior Publication Data

US 2013/0340900 A1 Dec. 26, 2013

(30) Foreign Application Priority Data

Mar. 31, 2011 (JP) ..... 2011-77107

(51) Int. Cl.

| | |
|---|---|
| ***C06B 31/00*** | (2006.01) |
| ***D03D 23/00*** | (2006.01) |
| ***D03D 43/00*** | (2006.01) |
| ***C06B 25/00*** | (2006.01) |
| ***C06D 5/06*** | (2006.01) |

(52) U.S. Cl.
CPC ..... *C06B 25/00* (2013.01); *C06D 5/06* (2013.01)

(58) Field of Classification Search
USPC ..... 149/88, 45, 109.2, 109.4; 117/11
See application file for complete search history.

(56) References Cited

U.S. PATENT DOCUMENTS

| | | | | |
|---|---|---|---|---|
| 2005/0098247 | A1* | 5/2005 | Wu | C06D 5/06 149/45 |
| 2005/0189052 | A1 | 9/2005 | Zeuner et al. | |
| 2005/0263224 | A1* | 12/2005 | Wu | C06D 5/06 149/46 |
| 2008/0149233 | A1* | 6/2008 | Kobayashi | C06D 5/06 149/109.2 |
| 2010/0078098 | A1* | 4/2010 | Wu | C06D 5/06 149/19.7 |
| 2012/0055593 | A1* | 3/2012 | Kobayashi | C06D 5/06 149/19.1 |

FOREIGN PATENT DOCUMENTS

| | | | |
|---|---|---|---|
| EP | 1 254 880 | A1 | 11/2002 |
| EP | 2 444 383 | A1 | 4/2012 |
| JP | 2004-231446 | A | 8/2004 |
| JP | 2005-119926 | A | 5/2005 |
| JP | 3907548 | B2 | 4/2007 |
| JP | 2010/269969 | A | 12/2010 |
| WO | WO 03/011798 | A1 | 2/2003 |
| WO | WO 2010/134466 | A1 | 11/2010 |

OTHER PUBLICATIONS

International Preliminary Report on Patentability and Written Opinion issued Oct. 2, 2013, in PCT International Application No. PCT/JP2012/057258.
International Search Report, mailed May 15, 2012, issued in PCT/JP2012/057258.
Extended European Search Report issued Oct. 6, 2014, in European Patent Application No. 12763900.3.

* cited by examiner

*Primary Examiner* — James McDonough
(74) *Attorney, Agent, or Firm* — Birch, Stewart, Kolasch & Birch, LLP

(57) ABSTRACT

Provided is a gas generating composition with a low combustion temperature, good ignition ability, and a high heat resistance. The gas generating composition includes: (a) a fuel; (b) an oxidizing agent including a basic metal nitrate; (c) a basic metal carbonate; and (d) a binder. The fuel of the component (a) includes melamine cyanurate (MC) and nitroguanidine (NQ), with a ratio (MC/NQ) of contents of MC and NQ being within a range of 0.3 to 1.5. The binder of the component (d) is one or two or more selected from: (d-1) starch, etherified starch, methyl cellulose, hydroxyethyl methyl cellulose, hydroxypropyl methyl cellulose, and hydroxyethyl cellulose; (d-2) poly(vinyl alcohol), polyvinyl ether, polyethylene oxide, polyvinyl pyrrolidone, and polyacrylamide; (d-3) guar gum, etherified guar gum, and tamarind gum.

4 Claims, No Drawings

GAS GENERATING COMPOSITION

TECHNICAL FIELD

The present invention relates to a gas generating composition that has a low combustion temperature, good ignition ability and a high heat resistance.

BACKGROUND ART

When a gas generating agent is used in an inflator for use in a safety apparatus for a vehicle such as a airbag apparatus disposed in a vehicle, it is very important to improve ignition ability of the gas generating agent in order to ensure product reliability.

And, it is important to decrease the combustion temperature of the gas generating agent because the heat load on the coolant disposed in the inflator can be reduced and an amount of the coolant can be decreased.

However, where the combustion temperature of the gas generating agent is decreased too much, the ignition ability is degraded. Therefore, it is desirable to decrease the combustion temperature and obtain excellent ignition ability at the same time.

Further, depending on the season or region, a vehicle can be exposed for a long time to high-temperature environment, and therefore it is also required that a gas generating agent in an inflator have high heat resistance.

JP-B No. 3907548 discloses a gas generating composition for an inflator including: (a) melamine cyanurate or a mixture of melamine cyanurate and a nitrogen-containing organic compound as a fuel, and (b) an oxygen-containing oxidizing agent, which can exhibit a specific effect such as a low combustion temperature and a small amount of generated hazardous gas, as a result of using novel melamine cyanurate as a fuel component.

It is described that the compounding ratio (mass ratio), nitrogen-containing organic compound/melamine cyanurate in the mixture of melamine cyanurate and nitrogen-containing organic compound is preferably 0.05 to 8, more preferably 0.1 to 6, and even more preferably 0.2 to 2. In this case, when the ratio of the nitrogen-containing organic compound/melamine cyanurate is 0.2 to 2, the content of melamine cyanurate is 33.3 to 83.3% by mass and the content of nitroguanidine is 16.7 to 66.7% by mass.

Decreasing combustion temperature is described as a problem to be solved, but improving ignition ability is not a problem to be solved, and it is only described that the ignition ability is improved by selecting an appropriate binder.

SUMMARY OF THE INVENTION

The present invention provides a gas generating composition containing: (a) a fuel; (b) an oxidizing agent containing a basic metal nitrate; (c) a basic metal carbonate; and (d) a binder, the fuel of the component (a) containing melamine cyanurate (MC) and nitroguanidine (NQ), with a ratio (MC/NQ) of contents of MC and NQ being within a range of 0.3 to 1.5; and the binder of the component (d) being one or two or more selected from:

(d-1) starch, etherified starch, methyl cellulose, hydroxyethyl methyl cellulose, hydroxypropyl methyl cellulose, and hydroxyethyl cellulose;

(d-2) poly(vinyl alcohol), polyvinyl ether, polyethylene oxide, polyvinyl pyrrolidone, and polyacrylamide; and (d-3) guar gum, etherified guar gum, and tamarind gum.

DETAILED DESCRIPTION OF THE INVENTION

The present invention is to provide a gas generating composition with a high heat resistance and also a low combustion temperature and good ignition ability. Thus, the gas generating composition in accordance with the present invention has a high heat resistance and also a low combustion temperature and good ignition ability.

<(a) Fuel>

The fuel of the component (a) used in accordance with the present invention includes melamine cyanurate and nitroguanidine, and may include only melamine cyanurate and nitroguanidine or these two components and additionally also a known other fuel within a range in which the present invention can be obtained.

A example of a known other fuel includes one, two, or more selected from tetrazole compounds such as 5-aminotetrazole and bitetrazole ammonium salt, guanidine compounds such as guanidine nitrate and dicyandiamide (nitroguanidine is excluded), and triazine compounds such as melamine, trimethylol melamine, alkylated methylol melamine, ammeline, ammeland, melamine nitrate, melamine perchlorate, trihydrazinotriazine, and a nitrocompound of melamine.

When a known other fuel is included in addition to the melamine cyanurate and nitroguanidine, a ratio of the other fuel in the fuel of the component (a) is equal to or less than 5% by mass.

<(b) Oxidizing Agent>

The oxidizing agent of the component (b) used in accordance with the present invention includes a basic metal nitrate and, as necessary, another oxidizing agent. By using the basic metal nitrate as the component (b), it is possible to decrease combustion temperature.

The basic metal nitrate can be one or two or more selected from basic copper nitrate, basic cobalt nitrate, basic zinc nitrate, and basic manganese nitrate. Among them, basic copper nitrate is preferred.

A example of other oxidizing agent includes metal nitrates, ammonium nitrate, metal perchlorates, ammonium perchlorate, metal nitrites, and metal chlorates.

<(c) Basic Metal Carbonate>

The basic metal carbonate of the component (c) used in accordance with the present invention is basic zinc carbonate, basic copper carbonate, or a combination thereof. By using the component (c), it is possible to reduce combustion temperature.

<(d) Binder>

The binder of the component (d) that is used in accordance with the present invention is one or two or more selected from:

(d-1) starch, etherified starch, methyl cellulose, hydroxyethyl methyl cellulose, hydroxypropyl methyl cellulose, and hydroxyethyl cellulose;

(d-2) poly(vinyl alcohol), polyvinyl ether, polyethylene oxide, polyvinyl pyrrolidone, and polyacrylamide;

(d-3) guar gum, etherified guar gum, and tamarind gum.

The binder of the component (d) can be a combination of a binder selected from (d-1), (d-2), and (d-3) and another known binder. A combination of a binder selected from (d-2) and a sodium salt of carboxymethyl cellulose is preferred.

The binder of the component (d) can be a combination of a binder selected from (d-1) and a binder selected from (d-2).

A combination of a binder selected from methyl cellulose, hydroxyethyl methyl cellulose, hydroxypropyl methyl cellulose, and hydroxyethyl cellulose of (d-1) and polyvinyl pyrrolidone of (d-2) is preferred.

<Other Components>

The gas generating composition in accordance with the present invention may also include various known additives in order to adjust the burning rate of the gas generating composition and purify combustion gas, within the range in which the present invention is obtained.

A example of a known additive includes metal oxides such as cupric oxide, iron oxide, zinc oxide, cobalt oxide, manganese oxide, molybdenum oxide, nickel oxide, bismuth oxide, silica, and alumina; metal hydroxides such as aluminum hydroxide, magnesium hydroxide, cobalt hydroxide, and iron hydroxide; cobalt carbonate, calcium carbonate; composite compounds of metal oxides or hydroxides such as Japanese acid clay, kaolin, talc, bentonite, diatomaceous earth, and hydrotalcite; metal salts such as sodium silicate, mica molybdate, cobalt molybdate, and ammonium molybdate; molybdenum disulfide, calcium stearate, silicon nitride, silicon carbide, metaboric acid, boric acid, and anhydrous boric acid.

In the gas generating composition in accordance with the present invention, the ratio (MC/NQ) of the contents of the melamine cyanurate (MC) and nitroguanidine (NQ) in the fuel of the component (a) is 0.30 to 1.50 and more preferably 0.5 to 1.30.

The contents of the components (a) to (d) in the gas generating composition in accordance with the present invention are described below:

The content of the fuel of the component (a) is preferably 15 to 40% by mass, more preferably 20 to 40% by mass;

The content of the basic metal nitrate of the component (b) is preferably 40 to 83% by mass, more preferably 40 to 75% by mass;

The content of the basic metal carbonate of the component (c) is preferably 1 to 15% by mass, more preferably 2 to 10% by mass; and The content of the binder of the component (d) is preferably 1 to 15% by mass, more preferably 3 to 10% by mass.

Since the binder of the component (d) burns and generates gas by itself, it can also function as a fuel. Therefore, it is desirable that the content of the binder be adjusted with consideration for oxygen balance of the entire gas generating composition.

The oxygen balance is the mass (represented by +) of oxygen generated when 1 g of the gas generating composition is completely burned, or the mass (represented by −) of oxygen required for the complete burning, and can be determined from a sum of multiplication-products of the oxygen balance and content (% by mass) of the components of the gas generating composition (see, for example, JP-A No. 2005-119926, in the paragraph [0038]).

The oxygen balance of the gas generating composition in accordance with the present invention is preferably +0.02 g/g to −0.02 g/g.

In the gas generating composition in accordance with the present invention, the pressure index (n) can be made equal to or less than 0.2, preferably equal to or less than 0.15, and more preferably equal to or less than 0.10.

the equation of pressure index (n): $r=aP^n$ where r is a burning rate, a is a constant (a value inherent to the gas generating composition), P is a pressure inside the inflator, and n is a pressure index (a value inherent to the gas generating composition).

The gas generating composition in accordance with the present invention can be molded into a desired shape, and a single perforated cylindrical molded article, a perforated cylindrical molded article, or a pellet-shaped molded article can be obtained. These molded articles can be manufactured by a method in which water or an organic solvent is added to and mixed with the gas generating composition and the obtained mixture is extrusion-molded (into the single-perforated cylindrical molded article or a perforated cylindrical molded article), or by a compression-molding method using a pelletizer or the like (for the pellet-shaped molded article).

The gas generating composition in accordance with the present invention or a molded article obtained therefrom can be used for, for example, an airbag inflator of a driver's side, an airbag inflator of a passenger side next to the driver, a side airbag inflator, an inflator for an inflatable curtain, an inflator for a knee bolster, an inflator for an inflatable seat belt, an inflator for a tubular system, and an inflator for a pretensioner, of various vehicles.

An inflator, that uses the gas generating composition in accordance with the present invention or a molded article obtained therefrom, may be of a pyrotechnic type in which a gas supply source is only a gas generating agent or of a hybrid type that uses both compressed gas, such as argon, and a gas generating agent.

Furthermore, the gas generating composition of the present invention or a molded article obtained therefrom can be also used as an igniting agent called an enhancer (or a booster), which serves to transmit the energy of a detonator or a squib to the gas generating agent.

EXAMPLES

The present invention is explained hereinbelow by Examples. The present invention is not limited to these Examples.

Examples and Comparative Examples

Gas generating compositions including components shown in Table 1 were manufactured. The properties shown in Table 1 were measured for those compositions. The results are shown in Table 1.

(1) Combustion Temperature

Combustion temperature based on theoretical calculations.

(2) Burning Rate

<Method for Preparing Cylindrical Strand>

Water was added to and mixed with the compositions of Examples and Comparative Examples, and the mixtures were extrusion-molded, cut, and dried to obtain single-perforated molded articles.

The obtained single-perforated molded article was pulverized in an agate mortar, and a powder, that has passed through a wire mesh with a mesh size of 500 μm, was loaded to a receiving die of a predetermined die.

A cylindrical strand with an outer diameter of 9.55 mm and a length of 12.70 mm was then molded by compressing for 5 sec under a gage pressure of 14.7 MPa applied by a hydraulic pump from the pestle-side end surface and then removing from the die.

An epoxy resin chemical-reaction-type adhesive "Bond Quick 30" manufactured by Konishi Co., Ltd. was applied to the side surface of the cylindrical strand and then thermally cured for 16 hours at 110° C., so as to obtain a sample which could be ignited and burned only from the end surface and could not be ignited from the side surface (unifacial propagating combustion).

<Method for Measuring Combustion Rate>

The cylindrical strand serving as a sample was installed in an SUS sealed bomb with an internal volume of 1 liter and pressurized to and stabilized at 6860 kPa, while the inside of the bomb was purged with nitrogen.

Then, a predetermined electric current was passed through a nichrome wire that was brought into contact with the end surface of the strand and the strand was ignited and burned by the fusion energy of the nichrome wire.

The behavior of pressure inside the bomb with time was verified by a recorder chart, a period of time from the start of the combustion until the peak of pressure rise was verified from the scale of the chart, and the numerical value that was obtained by dividing the length of the strand prior to combustion by the above period of time was taken as the burning rate.

The tests with pressurization and stabilization of 4900 kPa and 8820 kPa were performed in the same manner as described above.

(3) Pressure Index

The burning rate was measured under a nitrogen atmosphere and a pressure of 4900 kPa, 6860 kPa, and 8820 kPa by using the cylindrical strands manufactured by the above-described method.

In the Examples, a burning rate under 6860 kPa and a pressure index within a range of 4900 kPa to 8820 kPa are shown.

(4) Ignition Ability

The single-perforated molded article (with an outer diameter of about 4 mm, an inner diameter of about 1 mm, a length of about 4 mm) obtained by extrusion-molding was loaded into a combustion chamber of a gas generator (provided inside thereof with the combustion chamber with a volume of 31 $cm^3$; the total surface area of a plurality of gas discharge openings provided in the outer housing is 79.8 $mm^2$) for the evaluation test. The amount of the molded article was such that no unnecessary gap appeared in the combustion chamber and also such that the single-perforated molded article located inside the combustion chamber was not cracked when the gas generator was sealed. The amount of the single-perforated molded article used for the measurements is shown in Table 1.

The gas generator for the evaluation test had ignition device provided with an igniter including 55 mg of ZPP, and 4.5 g of a transfer charge including nitroguanidine, strontium nitrate, carboxymethyl cellulose strontium salt, and Japanese acid clay.

The gas generator for the evaluation test was disposed in a 60-liter tank (−40° C.) equipped with a sensor for pressure measurements. The combustion test was conducted by actuating the gas generator.

The actuation start time of the ignition device was taken as 0, and the ignition ability was evaluated by the time that had elapsed since the actuation start time and the value of pressure inside the 60-liter tank at the elapsed time.

Where the pressure at 10 milliseconds was equal to or greater than 30 kPa, the ignition ability was determined to be very good (◎). Where the pressure at 10 milliseconds was less than 50 kPa, the ignition ability was determined to be poor.

(5) Rupturing Time

The components of the compositions shown in Table 1 were mixed at the contents shown in Table 1, and then an amount of 30 g of each mixture was weighed. A total of 6 g of water was added thereto, and mixing was conducted for no less than 5 minutes in an antistatic vinyl bag. The lumps obtained were broken into small pieces, dried for 2 hours at 110° C., and then pulverized in a mortar to obtain powders.

A total of 1 g of the powder was placed into a die, a gage pressure of 14.7 MPa was applied with a hydraulic pump, the pressure was held for 5 seconds and then a cylindrical strand with a diameter of 9.55 mm was obtained.

A total of 20 strands (each 1 g) were prepared, introduced in a pressure vessel provided with a rupturing plate (made from aluminum) and heated for a maximum of 400 hours at 110° C. Where the decomposition gas was generated and the pressure inside the pressure vessel reached a predetermined level, the rupturing plate ruptures and the test was ended. The longer is the rupturing time, the higher is the heat resistance.

A total of 20 strands (each 1 g) manufactured in the same manner as in the above-described <Method for Preparing Cylindrical Strands> were prepared with the compositions shown in Table 2, and the heat resistance was evaluated in the same manner as for the compositions shown in Table 1.

Examples and Comparative Examples

Gas generating compositions including the components shown in Tables 1 and 2 were manufactured. The properties shown in Table 1 and 2 were measured with respect to those compositions. The results are shown in Tables 1 and 2.

TABLE 1

| | Composition (composition ratio: % by mass) | MC/NQ | Binder | Rupturing time (hour) |
|---|---|---|---|---|
| Example 1 | MC/NQ/BCN/BCC/CST (14.23/12/63.77/5/5) | 1.19 | CST | >400 |
| Example 2 | MC/NQ/BCN/BCC/HPS (14.23/12/63.77/5/5) | 1.19 | HPS | >400 |
| Example 3 | MC/NQ/BCN/BCC/HEC (14.23/12/63.77/5/5) | 1.19 | HEC | >400 |
| Example 4 | MC/NQ/BCN/BCC/PVA (14.23/12/63.77/5/5) | 1.19 | PVA | >400 |
| Example 5 | MC/NQ/BCN/BCC/PVP (14.23/12/63.77/5/5) | 1.19 | PVP | >400 |
| Example 6 | MC/NQ/BCN/BCC/PAA (14.23/12/63.77/5/5) | 1.19 | PAA | 376 |
| Example 7 | MC/NQ/BCN/BCC/Gum (14.23/12/63.77/5/5) | 1.19 | Gum | >400 |

TABLE 1-continued

| | Composition (composition ratio: % by mass) | MC/NQ | Binder | Rupturing time (hour) |
|---|---|---|---|---|
| Example 8 | MC/NQ/BCN/BCC/PAA/CMC-Na (14.23/12/63.77/5/2.5/2.5) | 1.19 | PAA/CMCNa | 359 |
| Comparative Example 1 | MC/NQ/BCN/BCC/CMC-Na (14.23/12/63.77/5/5) | 1.19 | CMCNa | 304 |
| Comparative Example 2 | MC/NQ/BCN/BCC/AGA (14.23/12/63.77/5/5) | 1.19 | AGA | 136 |
| Comparative Example 3 | MC/NQ/BCN/BCC/PAANa (14.23/12/63.77/5/5) | 1.19 | PAANa | 94 |

TABLE 2

| | Composition (Composition ratio: % by mass) | MC/NQ | Binder type | Burning temperature (K) | Burning rate (mm/s) | Pressure Index | Ignition ability: Low temp. −40° C. | Ignition ability: Amount used (g) | Rupturing time (hour) |
|---|---|---|---|---|---|---|---|---|---|
| Example 9 | MC/NQ/BCN/BCC/HEC (13.17/11/65.83/5/5) | 1.20 | HEC | 1536 | 16.1 | 0.16 | ○ | 33.5 | >400 |
| Example 10 | MC/NQ/BCN/BCC/PVP/HEC (12.13/11.5/66.37/5/2.5/2.5) | 1.05 | PVP/HEC | 1545 | 17.9 | 0.06 | ○ | 34.9 | >400 |
| Example 11 | MC/NQ/BCN/BCC/PVP (10.03/14/65.97/5/5) | 0.72 | PVP | 1569 | 19.9 | 0.07 | ○ | 34.6 | >400 |
| Example 12 | MC/NQ/BCN/BCC/PAA (8.87/16.5/64.63/5/5) | 0.54 | PAA | 1542 | 23.1 | 0.01 | ○ | 33.8 | 380 |

Component (a)
MC: melamine cyanurate
NQ: nitroguanidine
Component (b)
BCN: basic copper nitrate
Component (c)
BCC: basic copper carbonate
Component (d)
CST: starch (corn starch)
HPS: etherified starch (hydroxypropyl starch)
HEC: hydroxyethyl cellulose
PVA: poly(vinyl alcohol)
PAA: polyacrylamide
Gum: guar gum
CMCNa: carboxymethyl cellulose sodium salt The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A gas generating composition comprising: (a) a fuel; (b) an oxidizing agent comprising a basic metal nitrate; (c) a basic metal carbonate selected from the group consisting of a basic zinc carbonate, a basic copper carbonate, and a combination thereof; and (d) a binder, the fuel of the component (a) comprising melamine cyanurate (MC) and nitroguanidine (NQ), with a ratio (MC/NQ) of contents of MC and NQ being within a range of 0.3 to 1.5; and the binder of the component (d) being one or two or more selected from the group consisting of:

(d-1) starch, etherified starch, methyl cellulose, hydroxyethyl methyl cellulose, hydroxypropyl methyl cellulose, and hydroxyethyl cellulose;

(d-2) poly(vinyl alcohol), polyvinyl ether, polyethylene oxide, and polyvinyl pyrrolidone; and (d-3) guar gum, etherified guar gum, and tamarind gum, and wherein, when the fuel of the component (a) includes components other than MC and NQ, the ratio of the other components in the fuel of the component (a) is equal to or less than 5% by mass.

2. The gas generating composition according to claim 1, wherein the binder of the component (d) is a combination of a binder selected from the group consisting of (d-1) with a binder selected from the group consisting of (d-2).

3. The gas generating composition according to claim 1, wherein the content of the fuel (a) is 15 to 40% by mass;

the content of the oxidizing agent comprising a basic metal nitrate is 40 to 83% by mass;

the content of the basic metal carbonate (c) is 1 to 15% by mass; and the content of the binder (d) is 1 to 15% by mass.

4. The gas generating composition according to claim 1, wherein a pressure index (n) represented by the following equation below is equal to or less than 0.2:

the equation: $r=aP^n$ where r is a burning rate, a is a constant (a value inherent to the gas generating composition), P is a pressure inside an inflator, and n is a pressure index (a value inherent to the gas generating composition).

* * * * *